United States Patent [19]

Adam

[11] Patent Number: 4,691,926

[45] Date of Patent: Sep. 8, 1987

[54] RACKET, ESPECIALLY A TENNIS RACKET, HAVING A GRIP SLEEVE WITH SPRING ELEMENTS

[75] Inventor: Gunter Adam, Straubing, Fed. Rep. of Germany

[73] Assignee: PUMA AG Rudolf Dassler Sport, Herzogenaurach, Fed. Rep. of Germany

[21] Appl. No.: 644,016

[22] Filed: Aug. 24, 1984

[30] Foreign Application Priority Data

Sep. 7, 1983 [DE] Fed. Rep. of Germany ..... 3332289
Jan. 4, 1984 [DE] Fed. Rep. of Germany ..... 3400174

[51] Int. Cl.[4] ..... A63B 49/08
[52] U.S. Cl. ..... 273/73 J
[58] Field of Search ..... 273/73 J, 75, 73 E, 273/73 H, 81 C, 81 D, 81.2, 67 R, 73 R; 124/23 R, 24 R; 74/543, 551.1, 551.8, 551.9; 16/110 R; 7/167; 81/489

[56] References Cited

U.S. PATENT DOCUMENTS 3,674,267 7/1972 Hollis ..... 273/75

FOREIGN PATENT DOCUMENTS 1959368 11/1970 Fed. Rep. of Germany ..... 273/73 J
465270 5/1937 United Kingdom ..... 273/75

*Primary Examiner*—Anton O. Oechsle
*Assistant Examiner*—Matthew L. Schneider
*Attorney, Agent, or Firm*—Sixbey, Friedman & Leedom

[57] ABSTRACT

A racket, especially a tennis racket, having a frame surrounding a stringed hitting area, the frame being formed with a shaft on which a grip sleeve is mounted. In order to ensure that the grip sleeve is very stable and resistant to twisting and is arranged on the shaft either firmly or slidably, while manufacturing tolerances of the shaft and/or the grip shell can still be balanced, the following characteristics are provided:

(a) the grip sleeve is formed of one or more parts made of a hard elastic material;
(b) inwardly directed position-fixing elements are provided at the inside walls of the grip sleeve, the position-fixing elements centering the shaft in the grip sleeve, at least partly with little tolerance play;
(c) spring elements are provided between the inside walls and oppositely facing surfaces of the shaft;
(d) the spring elements brace the grip shell in a springy manner, but without play, relative to the shaft; and
(e) optionally, the shaft, itself, may be provided with stop surfaces that interact with the position-fixing element to further stabilize the grip against twisting.

40 Claims, 16 Drawing Figures

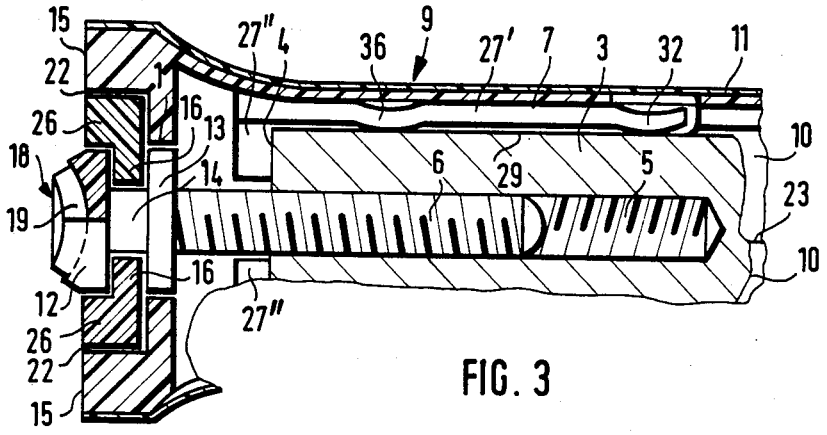
FIG. 3
FIG. 4
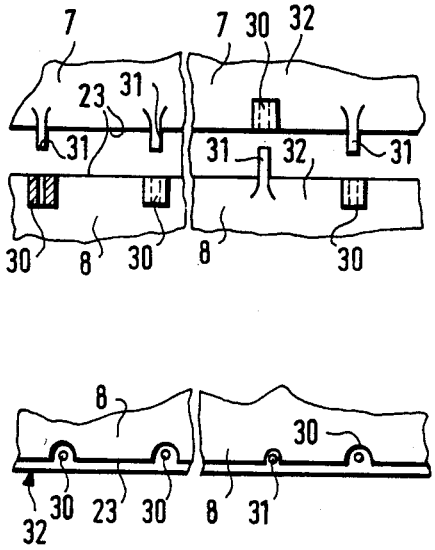
FIG. 5
FIG. 6
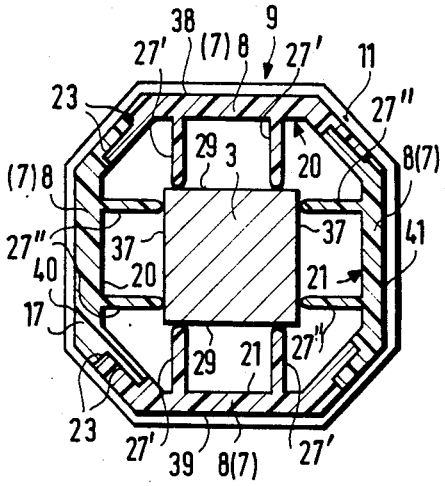

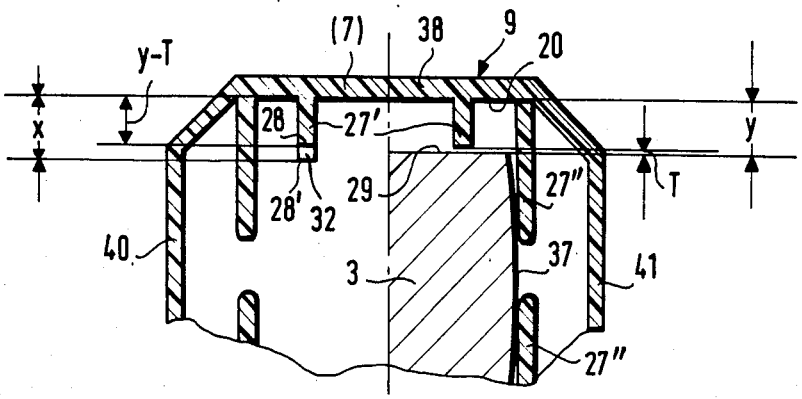
FIG. 10
FIG. 11
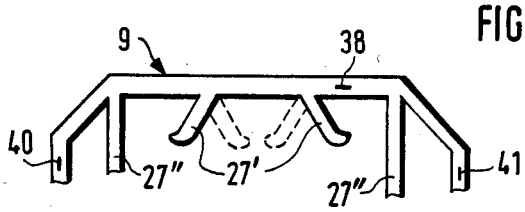
FIG. 13
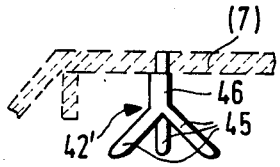
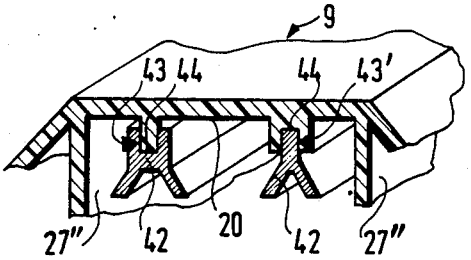
FIG. 12
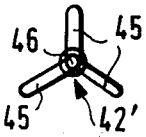
FIG. 14

RACKET, ESPECIALLY A TENNIS RACKET, HAVING A GRIP SLEEVE WITH SPRING ELEMENTS

BACKGROUND & SUMMARY OF THE INVENTION

This invention relates to a racket, especially a tennis racket, of the type having a hand-grip formed of a sleeve with longitudinally extending, internal positioning ribs that rest against the grip shaft of the racket frame when the hand-grip sleeve is mounted thereon.

Such a racket, having a hand-grip formed of a sleeve with ribs that extend inwardly from the inside of walls of the grip sleeve and firmly rest against the grip shaft is disclosed in German Offenlegungsschrift No. 19 59 368. However, since the cross section of the shaft, especially when it is made of wood or of a plastic material, can only be manufactured in a certain tolerance range, especially, when it is formed of injection-molded plastic, which experiences shrinkage and, thus, can only be manufactured with a relatively large tolerance in regard to a specified size. As such, it may happen that the grip shell will be too small so that, when it is pushed on or later during the play, it will rip or even burst, or it may be too large so that a firm hold of the grip sleeve on the shaft is not ensured.

On the basis of German Offenlegungsschrift No. 21 06 800, it is known to firmly arrange a hand-grip, formed of two half-shells, on the grip shaft of a racket frame by interposing a shock or vibration damping material. The two half-shells are screwed together, and the screws penetrate the grip shaft by means of boreholes that are larger than the diameter of the screws, so that the screws do not come in contact with the walls of the boreholes. However, to ensure that the screws do not contact the walls of the boreholes, the grip must not slide on the shaft, which means that the screws must be pressed firmly against the grip shaft. These measures are aimed at ensuring that hard impacts are not transferred to the arm of the player, especially a tennis player, in an undampened manner.

Finally, it is known from U.S. Pat. No. 3,674,267, in the case of a racket having a metal frame, it is known to form a grip shaft of two flat tubes of the frame that have several blocks interposed therebetween. The grip sleeve that is mounted on the grip shaft has longitudinal ribs which press against the shaft in a firm, but not a springy, fashion. Additionally, the grip shell can be slid on the shaft and can be locked in three positions.

This invention has the objective of developing a racket having a grip sleeve that is slid onto the grip shaft of the racket frame in such a way that said grip sleeve is very stable and resistant to twisting, and is either firmly or slidably arranged on the shaft, in a manner which enables the manufacturing tolerances of the shaft and/or the grip shell to be compensated for so that a firm connection between the shaft and grip shell can be achieved despite what might otherwise be unacceptable variances in size.

This objective is achieved through the provision of spring elements for enabling the hand-grip sleeve to be braced upon on the grip shaft of the racket frame without play.

The result is a grip shell that is very resistant to deformation and bending and can simply be slid onto the shaft and once on said shaft, practically cannot be deviated from the longitudinal axis of the shaft. This is achieved by means of the use of position-fixing elements in connection with the spring elements, where the position-fixing elements set, essentially, limit positions for the grip sleeve on the shaft, while the spring elements ensure a balance of tolerances and a permanent firm connection of the shaft and the grip shell.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 3 is a partial longitudinal section of the racket in the area of its hand-grip;

FIGS. 4 and 5 are plug-in elements for a grip sleeve consisting of several shell parts;

FIG. 6 is a view corresponding to FIG. 2, but of a modified embodiment of the hand-grip;

FIG. 10 is a part of a cross section of a grip, where the left side shows the grip shell without the shaft, and the right shell shows said grip shell with the shaft being slid in;

FIG. 11 shows a shell part or a grip sleeve with diagonally mounted spring elements;

FIG. 12 shows a shell part or a grip sleeve having rail-or ledge-mounted spring elements; and FIGS. 13 and 14 show individual insertable spring elements.

DETAILED DESCRIPTION OF THE PREFERRED EMBODIMENTS

Figures 1, 2:
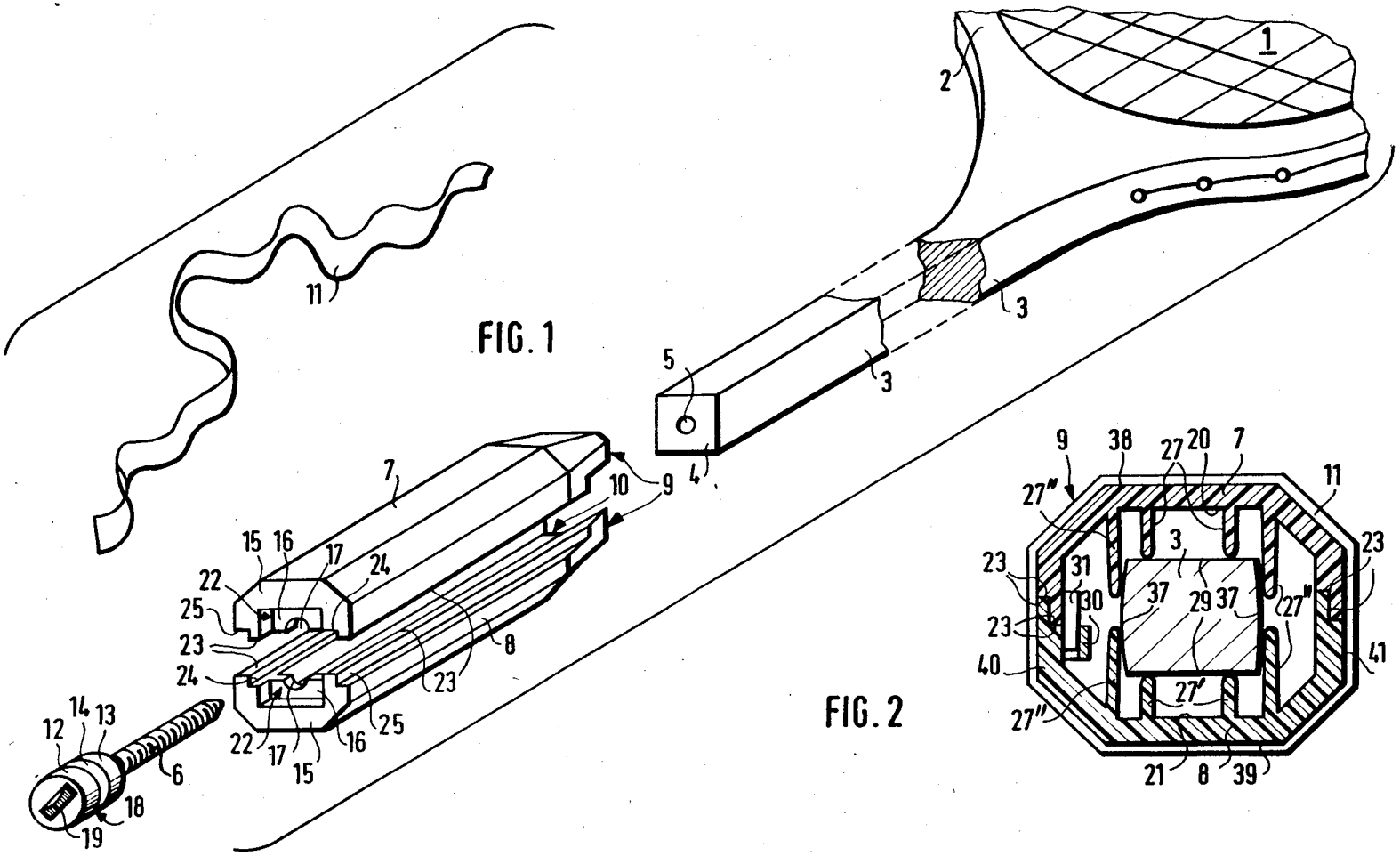
FIG. 1 is an exploded perspective view of a tennis racket.
FIG. 2 is a transverse cross-sectional view of the racket through its hand-grip.

A frame 2 surrounding a hitting area 1, of a racket, especially a tennis racket, has a shaft, upon which a hand-grip is formed. In its cross section, the shaft 3 is, preferably, of a rectangular or square shape, but may be two rods or rod ends, when the frame is formed of a bent tube or a rod.

In the shaft end 4, a borehole 5 having a thread is provided into which an adjusting screw 6 can be screwed.

A grip sleeve 9, comprised of two half-shells 7 and 8, is arranged on the shaft 3. The half-shells 7, 8 consist of a hard, practically non-compressible material, such as rigid expanded plastics, especially those based on hard polyurethane, hard polyvinyl chloride, polyamide, polypropylene, polyethylene, etc. These materials will slide relatively well on the shaft 3, whether it is formed of wood, metal or plastic, and are wear resistant.

The two half-shells 7, 8, when mounted on the shaft 3, are wound over with a grip strip such as the elastic strip 11. The thus formed grip sleeve 9 is provided with longitudinal ribs that are formed on interior walls of the half-shells 7,8. The ribs serve as sliding surfaces and may be used, at the same time, for a balancing of tolerances.

In order to be able to adjust the axial position grip sleeve 9 on the shaft 3 at any time, an adjusting screw 6 is provided which serves as an adjusting means and is applied between the grip shell 9 and the shaft 3. The adjusting screw 6, by means of a tongue-and-groove connection, is connected with the grip sleeve 9. This connection is formed by a surrounding groove 14 formed between two guide disks 12, 13 on the head 18 of screw 6 and by teeth or tongues projecting inwardly from ends 15 of the half-shells 7,8 into said groove 14. The teeth or tongues, in the illustrated embodiment, are formed by inwardly projecting walls 16 having semicircular recesses 17 (FIG. 1) for the adjusting screw 6.

Consequently, the adjusting screw 6 is disposed so that it cannot be slid axially, but can be rotated. By means of threading screw 6 into the borehole 5, the grip shell 9 can be slid longitudinally along the shaft 3 and, thus, its position can be adjusted relative to the shaft 3. For the turning of the adjusting screw 6, said screw is provided with a slot 19 in its head 18.

After the adjusting screw 6 is inserted into the half-shells 7,8, with the walls 6 engaged in the groove 14, the half-shells 7,8, are firmly connected with one another at their longitudinally extending edges, for example, by point-like or continuous gluing and/or ultrasonic sealing and/or a thermosealing process. So that the half-shells 7,8 can be fitted together precisely, their longitudinally extending edges 23 are provided with a tongue and groove or with rabbets. Advantageously, this arrangement is made in such a way that one of the longitudinally extending edges 23 has a groove and the other one has a tongue, or, as shown in FIGS. 1 and 2, one parting edge 23 has an inside rabbet 24 and the other one has on outside rabbet 25. Thus, the half-shells 7, 8 can be identical, so that only one mold is required for their manufacture.

As shown in FIG. 3, the teeth or tongues formed by walls 16 may be provided by special sliding components 26 consisting of highly wear-resistant material of low friction. The material used for this purpose is, for example, polyamide, polycarbonate, aluminum, brass, steel or a similar material. Preferably, two sliding components 26, that can be fitted together to form a disk, can be inserted in a recess 22 at the extreme end 15 of the grip sleeve 9 and can be fastened in it. The fastening, preferably, takes place by screwing-in and/or gluing-in.

Advantageously, the contour of the recess or the indentation 22 is not circular, and the sliding components 26 are matched to this contour so that they are held in the identation 22 and cannot be twisted, and can thus be fastened easily by being locked in and/or being glued in.

In an advantageous development of the invention, the half-shells 7, 8 may be provided with a flexible layer, such as a foamed material, a foam rubber or a similar material, or may be subsequently surrounded by it, for example, by spraying. This results in a good damping of hard hits and impacts so that these are not transferred directly to the hitting arm of the player.

Instead of a tongue-and-groove connection at the longitudinally extending edges 23, or instead of an inside rabbet 24 and an outside rabbet 25, bushings 30 and/or pins 31 may, according to FIGS. 4 and 5, be provided in the area of the longitudinal edges 23, along the parting planes 23 of the shell parts, at a distance from one another in such a way that, when two half-shells 7, 8 are fitted together, a pin 31 of one half-shell 7 or 8 fits into a respective bushing 30 of the other half-shell 8 or 7. For example, in the area of one edge 23 of one half-shell 7 or 8, only bushings 30 may be provided, and in the area of the other edge 23 of half-shell 7 or 8, only pins 31 may be provided (FIGS. 4 and 5, on the left), or in the area of each edge 23 of a half-shell 7, 8, bushings 30 and pins 31 are provided alternately, in such a way that when two identical half-shells 7, 8 are fitted together, one pin 31 is, in each case, opposite one bushing 30 and these can be fitted into one another (FIGS. 4 and 5, on the right). Advantageously, the pins 31, at least toward their ends, are slightly conically tapered, for example, at an angle of 1 to 5 degrees, so that they wedge when they are pressed into the bushing 30.

The length of the adjusting screw 6 and the depth of the borehole 5 are dimensioned in such a way that the grip sleeve 9 can be displaced along the shaft 3 by about 20 mm to 40 mm. However, as a rule, an adjustment by + or −10 mm, starting out from a normal position, is sufficient, as demonstrated by tests. By means of sliding of the grip sleeve 9, the racket can be adapted easily to the player's skill and/or strength and/or game.

So that the rigid grip sleeve 9 firmly rests against the shaft 3, the grip sleeve 9, on the inside, and shaft 3, on the outside, must be precisely adapted to one another. If this does not take place, a rebounding between these parts may take place during hitting, especially during very hard hits, causing an undesirable, unpleasant noise and possibly a rapid wear of the grip shell and/or the shaft.

In order to be able to permit the use of tolerances that are large enough for a rational manufacturing process, spring elements are provided, according to the invention, between the inside walls of the grip sleeve 9 and the exterior surfaces of the shaft 3. The spring elements having a plus tolerance and are stressed when the grip sleeve 9 is slid onto the shaft 3. Thus, the grip sleeve 9, under initial tension, rests against the shaft 3, which avoids the above-mentioned effects or reduces them to bearable, non-distrubing values. Nevertheless, the grip sleeve 9 can be slid on the shaft 3, when a racket is desired to have a length that can be adjusted.

An advantageous development of this embodiment of the invention is shown in FIGS. 2, 3 and 10. At opposite inside walls 20, 21 of the half-shells 7, 8, longitudinal distance ribs 27, 27′ are provided that serve as position-fixing elements and project perpendicularly from these inside walls 20, 21. Furthermore, the width of the distance ribs is smaller than the width of the shaft 3 and they have a length that is shorter than the distance Y (FIG. 10), required to bring their end edges or end surfaces 28 into interacting engagement with a respective shaft surface 29, by a distance T of 0.2 to 0.5 mm that, for example, corresponds approximately to the manufacturing tolerance. These longitudinal distance ribs 27′, therefore, essentially, fix the position of the shaft 3 relative to movement in upward and downward directions.

However, in order to compensate for the play between the grip sleeve 9 and the shaft 3 caused by the distance T, one or more spring elements, in the form of a flexible tongue 32 (FIG. 3 and FIG. 7), are provided as a cantilevered free end of the longitudinal distance rib 27′. Each flexible tongue 32 extends diagonally inwardly from a longitudinal distance rib 27′, so that its end edge or end surface 28' is spaced from the inside wall 20 or 21 by a distance X (FIG. 10) that is greater than the distance Y between the inside wall 20 or 21 and the corresponding shaft surface 29. Thus, when the grip sleeve 9 is slid onto the shaft 3, these flexible tongues 32 are stressed as they are bent back by engagement with the shaft 3, so that the grip sleeve 9 is held on the shaft 3 without play and in spring-biased manner.

Figure 7:
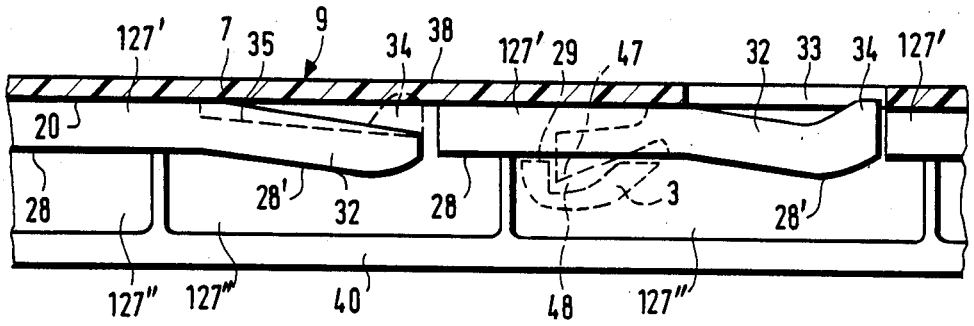
FIG. 7 is a longitudinal section through a shell part of a grip sleeve having flexible tongues.

To enable this arrangement to be easily manufactured, the grip sleeve 9, above the flexible tongues 32, may have recesses 33 of a width that is at least as wide as that of the flexible tongue 32 or wider, so that the tongues can flexible enter into these recesses 33. In order to facilitate the entry into the recesses 33, the flexible tongues 32 may be provided with a nose 34 that is directed upward. Alternatively, as shown in FIG. 7, on the left, by the broken line 35, the flexible tongue 32 may have a shorter height than the longitudinal distance ribs 127' and be spaced from the inner wall 20, 21 by a stepped junction with ribs 127'. With such an arrangement, recess 33 will then not be required, since the range of movement available before the spring element 32 reaches the inside wall 20 or 21 will be sufficient to achieve the desired tolerance compensation effect.

Figure 9:
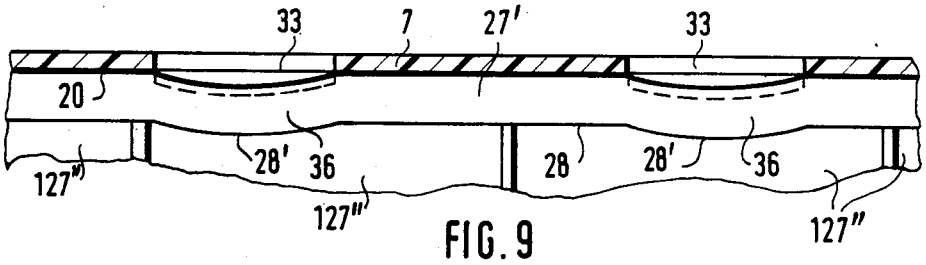
FIG. 9 is a longitudinal section of a shell part of a grip sleeve having elastic arched ribs.

Instead of the flexible tongues 32 that are cantilevered from ribs 27', 127', the spring elements may be formed by an arched rib portion 36, as shown in FIG. 3 on the left and in FIG. 9. Each arched rib portion 36 is curved away from the adjacent inner wall 20, 21, toward the inside, at both ends. This construction results in a higher spring force than that achieved by spring elements formed as tongues 32. Recesses 33 may be provided in conjunction the arched portions 36 (FIG. 9) and/or the rib height may be reduced by being inwardly stepped at its junction with rib 27' as represented by broken line 35.

The length of a flexible tongue is about 0.5 to 1.5 cm. In the case of an arrangement on partial longitudinal distance ribs 127', the length is about 20 to 60% of the length of this part 127'.

Figure 8:
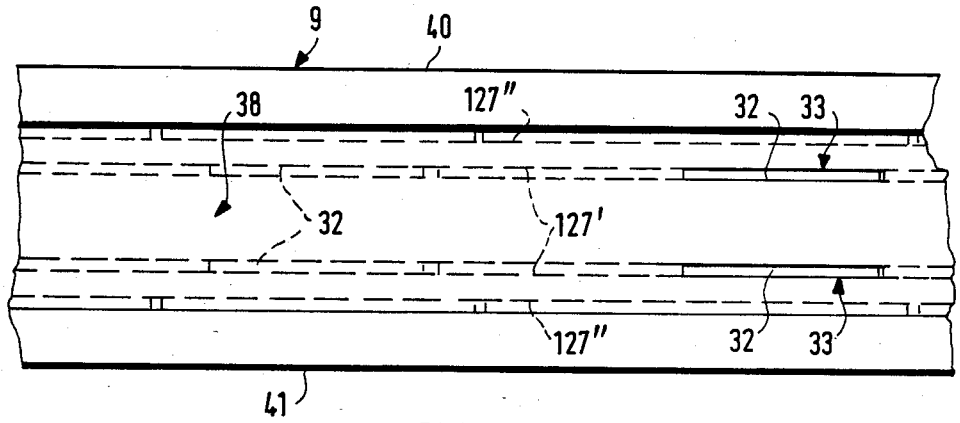
FIG. 8 is a top view of the grip shell according to FIG. 7.

Also provided are higher outside longitudinal ribs 27'' (FIG. 2) that also project perpendicularly from the inside walls 20, 21. The widthwise clearance between the ribs 27'' of each wall 20, 21 is only slightly less than the width of the shaft 3. Consequently, when the grip sleeve 9 is slid on, each rib 27'' is laterally deflected in an elastic manner by a respective shaft surface 37 (as most clearly shown in FIG. 10). These longitudinal ribs 27'', under the initial stress created by the noted deflection thereof, always rest against the shaft surfaces 37 and are, therefore, used as lateral position-fixing elements and, at the same time, for balancing the tolerances relative to the sides of shaft 3. The longitudinal ribs 27'', just like the longitudinal distance ribs 27', may extend over the whole length of the grip or they may be subdivided into sections 127'' (compare FIG. 7 to 9).

As previously indicated, since the longitudinal distance ribs 27' have spring elements with a plus tolerance (equal to distance x− distance (y+T), the spring elements, when the grip sleeve 9 is slid onto the shaft 3, always firmly engage against the shaft.

The special arrangement of the longitudinal ribs 27'' in the mentioned direction permits the manufacturing of the grip shell 9 from, in particular, identical half-shells 7, 8 which may be manufactured, such as by injection molding, by means of a simple, two-piece mold.

It is also possible, preferably in addition, to manufacture the longitudinal distance ribs 27' in an oversize or to make the spring force of the flexible tongues 32 or the arched ribs 36 so large and at the same time, the wall thickness of the grip sleeve 9 or the shell parts 7, 8 forming it so thin that, when the grip sleeve 9 is pushed onto the shaft 3, the upper and lower wall 38, 39 of said grip 9 are flexibly deformed outwardly while the sidewalls 40, 41 are, at the same time, pulled toward the inside. In this case, the shell parts 7, 8 or the grip shell 9 are formed in such a way that its unstressed (rest) position off of the racket shaft does not correspond to its intended final form, the final form with the desired dimensions being achieved as a result of deformation produced when sleeve 9 is pushed onto the shaft 3.

Without deviating from the concept of the invention, the longitudinal distance ribs 27', possibly together with the spring elements or parts thereof, may be arranged diagonally (FIG. 11), namely preferably with a diagonal orientation outwardly away from each other and toward the side walls 40, 41 of sleeve 9 or, as shown by the broken line, they may be formed in a V-shaped manner.

Instead of the molded-on longitudinal distance ribs 27', spring elements in the form of Y-shaped rails or rail sections 42 may be provided. As shown in FIG. 12, the rails may be manufactured as individual elements that are subsequently attached to the sleeve 9 by means of grooves 43 in the rails 42 that fit on projections 44 of the inside wall 20 or 21, such as by being slid on (left embodiment), and they may be firmly secured thereto, for example, by being glued, locked, etc. Alternatively, a groove 43' may be provided in a channel-like projection 44', on inside wall 20 or 21, into which a base leg of a rail 42 of Y-shaped cross section may be inserted with (right-hand embodiment), the free other branches serving for engagement on the surface of shaft 3.

Individual spring elements 42' in the form of plungers with, for example, spiral springs, or individual elements having laterally, diagonally downward directed projecting flexible feet 45 may advantageously also be provided.

The embodiments of the last-mentioned type are shown in FIGS. 13 and 14, the branches 45 of which extend in the directions of straight lines from the apex of a tetrahedron to its base corners. The upright branch 46, in this case, is advantageously used for fastening the spring elements to the wall of the grip sleeve 9 or to the shaft 3. The same fastening principle is naturally also applicable to the rail shaped spring elements 42.

The fastening of the individual spring elements 42, 42' onto the grip sleeve 9 takes place before its shell parts are assembled, and only then does the, advantageously, undetachable connection of the shell parts into the rigid grip sleeve 9 take place. This rigid connection may, for example, also take place by means of snapping or locking elements, by means of very high frictional locking, by barbs, etc., possibly with an additional gluing or sealing.

In order to practically completely avoid a twisting of the grip shell 9 with respect to the shaft 3, because of the elasticity of the longitudinal ribs 27, 27' as well as of the spring elements 32, 36, in accordance with a further aspect of the invention, stop surfaces 201 may be provided on the shaft surfaces 37 for interacting with the longitudinal ribs 27'. The stop surfaces 201 are disposed at least approximately normal to the respective shaft surface 37 and interact with an end surface 202 of the longitudinal ribs 27'', for providing a means for securing the grip sleeve 9 against twisting.

Figure 15:
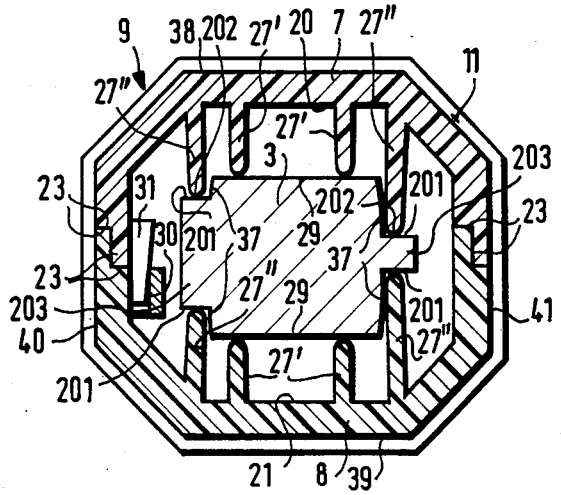
FIGS. 15 and 16 are views corresponding to those of FIGS. 2 and 10, respectively, showing the use of a shaft with stop surfaces.
Figure 16:
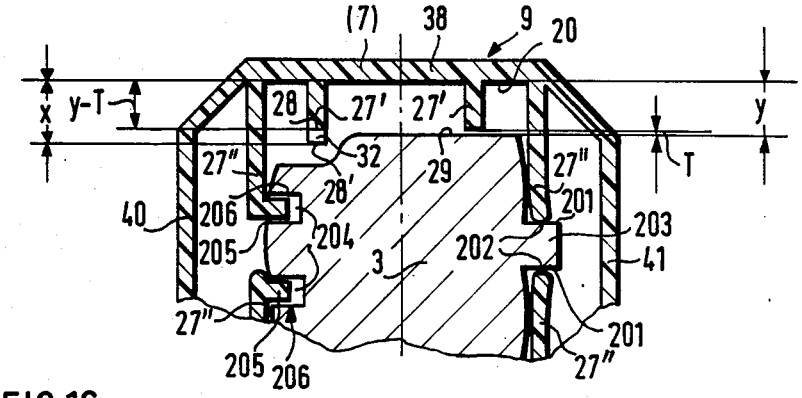

An embodiment where the stop surface 201 is arranged on a longitudinal ridge 203 projecting from the shaft surface 37 is shown in FIG. 15 and in enlarged form in the right side of FIG. 16. In this case, the longitudinal ribs 27'', under the effect of torsional forces, are stressed with respect to pressure and can, therefore, not give way elastically. During hitting, there will, therefore, no longer be any noticeable twisting.

The stop surfaces 201 may also be provided in a longitudinal groove 204 or in two parallel longitudinal grooves 204. The longitudinal ribs 27'' will in that case be provided with an inwardly directed locking ridge 205 on its end or in the end area. When a single longitudinal groove 204 is used, the surface 206 of the locking ridges 205 facing outwardly (e.g. top of ridge 205 of the upper left rib 27'') will then interact with a stop surface 201 formed by an inwardly directed wall (e.g. the top wall of upper groove 204). In the case of two parallel grooves 204, as shown on the left side of FIG. 16, both surfaces of the locking ridges 205 may interact with both stop surfaces 201 of the longitudinal grooves 204. Advantageously, the shaft 3 is developed to be rectangular, and the stop surfaces 201 are provided on surfaces 37 of the narrow side of the shaft.

It is true that the embodiment of FIG. 1 shows a grip shell 9 that can be slid and adjusted on the shaft 3. However, the invention may also be used in the case of grips where the slidability of the grip shell 9 is not required or desired.

In order to fasten the grip shell 9 on the shaft 3 so that it cannot be lost, i.e., so that normally it can no longer be pulled off, a catch prong 47 (shown by an interrupted line in FIG. 7) may be provided on an inside wall, such as the inside wall 20, 21, said catch prong 47 being able to lock into a countercatch 48 of the shaft 3. The catch prong 47 may be part of the longitudinal distance ribs 27' or of the longitudinal ribs 27''. Advantageously, the end or an inside end edge 48 of the longitudinal ridge 203 or the longitudinal groove 204 forms the countercatch for the catch prong 47.

So that, in the case of the slidable grip sleeve 9, the grip sleeve 9 still rests firmly against the shaft 3 in the most extreme position, i.e., in the position of the longest distance of the hand-grip from the hitting surface 1, at least two spring elements are provided in this position, on opposite sides (inside walls 20, 21). The illustrated two-row arrangement of the longitudinal distance ribs 27' is, therefore, especially advantageous because the spring elements, when stressed by the player, rest against the shaft 3 in the area of the edges, and the grip shell 9 is therefore optimally supported on the shaft 3 against twisting. However, more rows or additional flexible sections may also be provided.

The invention may be used, advantageously, in the case of a grip sleeve made of an extruded, tube-shaped material, especially when the longitudinal distance ribs 27' are to be arranged diagonally, as in FIG. 11. In this case, the longitudinal ribs 27'' may also be arranged diagonally or they may be arranged perpendicularly as in the arrangement shown in FIG. 6.

While it may be possible to achieve the objective on which the invention is based by means of a single spring element, for example, one arranged in the center of the length of the grip sleeve, it is more advantageous to arrange at least one at each of its two end points, or even better to distribute three or more evenly over the length of the grip sleeve.

The longitudinal ribs 27'' may be developed identical to or similar to the longitudinal distance ribs 27', when the grip shell 9 is, for example, formed of four shell parts 7 or 8 in the manner shown in FIG. 6. These four shell parts are also firmly connected with one another in a form-locking manner.

It is also possible to develop the spring elements differently from the various forms illustrated, but in any such case is important that the spring elements always are constructed with a plus tolerance so that, when the grip sleeve 9 is mounted onto the shaft 3, the spring elements will engage against the shaft 3 with sufficient prestressing to fasten the grip sleeve 9 firmly on the shaft 3.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A racket having a frame surrounding a stringed hitting area, said frame forming a shaft onto which a grip sleeve that has position-fixing elements in the form of inwardly projecting longitudinally extending, distance ribs is mounted for forming a hand-grip, said position-fixing elements resting against said shaft, wherein, spring elements are provided between inside walls of the grip sleeve and oppositely facing surfaces of said shaft for bracing the grip shell, without play, against the shaft in a spring-biased manner, wherein longitudinal ribs are provided that are arranged opposite one another and directed toward one another, said longitudinal ribs, when the grip sleeve is mounted onto the shaft, laterally resting against the shaft under stress, and wherein, in an area between said longitudinal ribs, at least one of said position fixing elements with at least one said spring element is provided, between a respective inside wall of the grip sleeve and a facing surface of the shaft, an end surface of the spring element having an undeformed height relative to an associated inside wall that is greater than a distance of the facing surface of the shaft from the associated inside wall so that, when the grip sleeve is mounted onto the shaft, the spring element rests against the facing shaft surface with the spring elements having been outwardly deflected in a springy manner.

2. A racket according to claim 1, wherein the position-fixing elements with the spring elements are positioned laterally of and close to the longitudinal ribs which rest laterally against the shaft.

3. A racket according to claim 1, wherein at least one of the position-fixing elements that are in the form of longitudinal distance ribs, has at least one section that is flexible in a direction normal to the facing surface of the shaft and which forms a said spring element, portions of said spring element forming section, other than that having said end surface with an undeformed height that is a greater distance from the inside wall than the distance of the facing surface of the shaft from the inside wall, having a height that is a distance from the inside wall that is no greater than that of the facing surface of the shaft.

4. A racket according to claim 3, wherein at least some of the spring elements are formed by cantilevered ends of the ribs forming said position-fixing elements.

5. A racket according to claim 4, wherein the cantilevered ends of the ribs are spaced away from the associated inner wall by a stepped junction with the distance ribs forming the position-fixing elements.

6. A racket according to claim 4, characterized in that a recess is provided, in the wall of the grip sleeve above a spring element, that is adapted to approximately the length and approximately the width of the spring element.

7. A racket according to claim 6, wherein the spring element has a nose that engages, at least during outward deflection, into the recess.

8. A racket according to claim 3, wherein at least some of the spring elements are formed as a flexible arched portion of the ribs forming the position-fixing elements that are bent inwardly.

9. A racket according to claim 8, wherein the height of the arched portion of the rib forming the spring element is less than that of a non-flexible part of the rib forming position-fixing element, such that the arched portion is stepped away from an adjacent inner wall of the grip sleeve.

10. A racket according to claim 8, characterized in that a recess is provided, in the wall of the grip sleeve above a spring element, that is adapted to approximately the length and approximately the width of the spring element.

11. A racket according to claim 3 characterized in that the position-fixing elements extend perpendicularly relative to the facing surface of the shaft.

12. A racket according to claim 1, wherein the position fixing elements extend perpendicularly relative to the facing surface of the shaft.

13. A racket according to claim 1, wherein at least the spring elements are at least partly arranged diagonally relative to the facing surface of the shaft.

14. A racket according to claim 1, wherein the grip sleeve is slidable on the shaft and spring elements, at least on one side, are formed as sliding elements.

15. A racket according to claim 1, wherein a spring element is formed as a locking element for the locking of the grip sleeve with the shaft.

16. A racket according to claim 15, wherein said locking element is constructed as a means for permitting sliding-on of the grip shell onto the shaft and for resisting sliding-off of the grip shell from the shaft.

17. A racket according to claim 2, wherein said longitudinal ribs are longitudinally sub-divided into rib sections.

18. A racket according to claim 1, wherein the position-fixing elements are formed as longitudinal ribs that are molded onto the inside wall of opposite walls of the grip sleeve and that extend from one inside wall toward an opposite inside wall at positions for laterally interacting with surfaces of the shaft; wherein the shaft surfaces that laterally interact with the longitudinal ribs are provided with stop surfaces extending substantially normal to the laterally interacting shaft surfaces, said stop surfaces interacting with at least one of an end surface and a surface of an inwardly extending ridge of the longitudinal ribs for providing a secure protection against twisting of the grip sleeve.

19. A racket according to claim 18, wherein the stop surfaces extend longitudinally along the shaft.

20. A racket according to claim 18, wherein the stop surfaces are formed by side surfaces of a longitudinal ridge on at least one of the laterally interacting shaft surfaces.

21. A racket according to claim 18, wherein the stop surfaces are formed by side surfaces of at least one longitudinal groove in at least one of the laterally interacting shaft surfaces, and the longitudinal ribs have a locking ridge engaging in said groove.

22. A racket according to claim 21, wherein two parallel longitudinal grooves are provided into which, in each case, one locking ridge of a respective longitudinal rib engages.

23. A racket according to claim 22, in that the longitudinal ribs engage the shaft under tension.

24. A racket according to claim 23, wherein parts of the longitudinal ribs which engage the shaft under the tension rest against the stop surfaces.

25. A racket according to claim 18, wherein the stop surfaces are provided at narrow side surfaces of the shaft whose cross-sectional shape is rectangular.

26. A racket according to claim 18, wherein the grip sleeve is provided with a gripping prong that coacts with a countercatch of the shaft to form a locking means for preventing unintentional pulling-off of the grip sleeve.

27. A racket according to claim 26, wherein the gripping prong is formed on the longitudinal ribs and the countercatch is formed on a longitudinal ridge having a said stop surface.

28. A racket, especially a tennis racket, with a frame surrounding a ball hitting area, said frame having a shaft onto which a grip sleeve is mounted to form a hand-grip, and an adjustment means for adjusting the length of the racket by changing the position of the hand-grip on the shaft, wherein said grip sleeve is formed of at least two at least similar sleeve parts that are formed of a hard, elastically resilient material and that have projections which extend inwardly toward the shaft and run in a longitudinal direction relative to the shaft, and wherein said projections of the sleeve parts comprise resiliently deflectable means for balancing of tolerances between the grip sleeve and the shaft by resiliently resting against the shaft.

29. A racket according to claim 28 wherein said projections comprise first position-fixing elements, said first position-fixing elements incorporating spring elements and being arranged in a manner that, when the grip sleeve is mounted on the shaft, they engage front and back sides of said shaft, and second, lateral position-fixing elements that engage oppositely facing lateral sides of said shaft when the grip sleeve is mounted on the shaft.

30. A racket according top claim 29, wherein said second position-fixing elements are longitudinal ribs that project from different inner surfaces of the grip sleeve than the first position-fixing elements and are arranged to contact said shaft at a respective free end of each rib.

31. A racket according to claim 29, wherein said second position-fixing elements are longitudinal ribs that project from the same inner surfaces of the grip sleeve as the first position-fixing elements and are arranged to laterally rest against the lateral sides of the shaft under stress when the grip sleeve is mounted on the shaft.

32. A racket according to claim 29 wherein said first position-fixing elements are longitudinally extending ribs and spring elements are formed by flexible sections of the ribs forming said first fixing elements.

33. A racket according to claim 32, wherein at least some of the spring elements are formed by cantilevered ends of the ribs forming said first position-fixing elements.

34. A racket according to claim 32, wherein at least some of the spring elements are formed as a flexible arched portion of the ribs forming the first position-fixing elements that are bent inwardly.

35. A racket according to claim 28, wherein said deflectable means comprise spring elements.

36. A racket according to claim 35, wherein at least the spring elements are at least partially arranged diagonally relative to a facing surface of the shaft.

37. A racket according to claim 35, wherein at least one spring element is engageable with a countercatch of the shaft in a manner that the grip sleeve, once mounted, is slidable on the shaft but is precluded from being removed therefrom.

38. A racket according to claim 28, wherein the sleeve parts are solidly fastened to one another along separation surfaces.

39. A racket according to claim 28, wherein the sleeve parts are connected in an interlocking manner by providing the sleeve parts with separation surfaces with mutually engageable projections and recesses.

40. A racket according to claim 28, wherein the fastening of the sleeve parts to one another is formed by one of gluing, ultrasound and heat welding.

* * * * *